US007686747B1

(12) United States Patent
Blackford

(10) Patent No.: US 7,686,747 B1
(45) Date of Patent: Mar. 30, 2010

(54) EXERCISE DEVICE

(76) Inventor: Richard Blackford, 807 S. Venice Blvd., Venice, FL (US) 34293

( * ) Notice: Subject to any disclaimer, the term of this patent is extended or adjusted under 35 U.S.C. 154(b) by 121 days.

(21) Appl. No.: 12/151,212

(22) Filed: May 5, 2008

Related U.S. Application Data

(63) Continuation-in-part of application No. 11/478,867, filed on Jun. 30, 2006, now abandoned.

(51) Int. Cl.
*A63B 21/065* (2006.01)

(52) U.S. Cl. ..... 482/105

(58) Field of Classification Search ..... 482/82, 482/91–95, 97–98, 105, 109, 148; 600/29–30, 600/32, 38; 473/334–339; *A63B 21/065*
See application file for complete search history.

(56) References Cited

U.S. PATENT DOCUMENTS

| | | | | | |
|---|---|---|---|---|---|
| 1,930,342 | A * | 10/1933 | Graham | ..... | 473/232 |
| 4,052,075 | A * | 10/1977 | Daly | ..... | 473/338 |
| 5,213,557 | A * | 5/1993 | Firth | ..... | 482/105 |
| 2004/0038783 | A1 * | 2/2004 | Hunter | ..... | 482/105 |

* cited by examiner

*Primary Examiner*—Loan H Thanh
*Assistant Examiner*—Oren Ginsberg

(57) ABSTRACT

A pelvic muscle strengthening device has a conical body with a hollow interior with an interior and an exterior surface. An end cap has a forward face formed with a threaded recess. A cylindrical stud extends into the body and has a trailing end formed with threads for removable coupling with the end cap. A plurality of weights are carried by the stud. A circular central opening with slits in a cross-like configuration in the body.

5 Claims, 4 Drawing Sheets

FIG 4
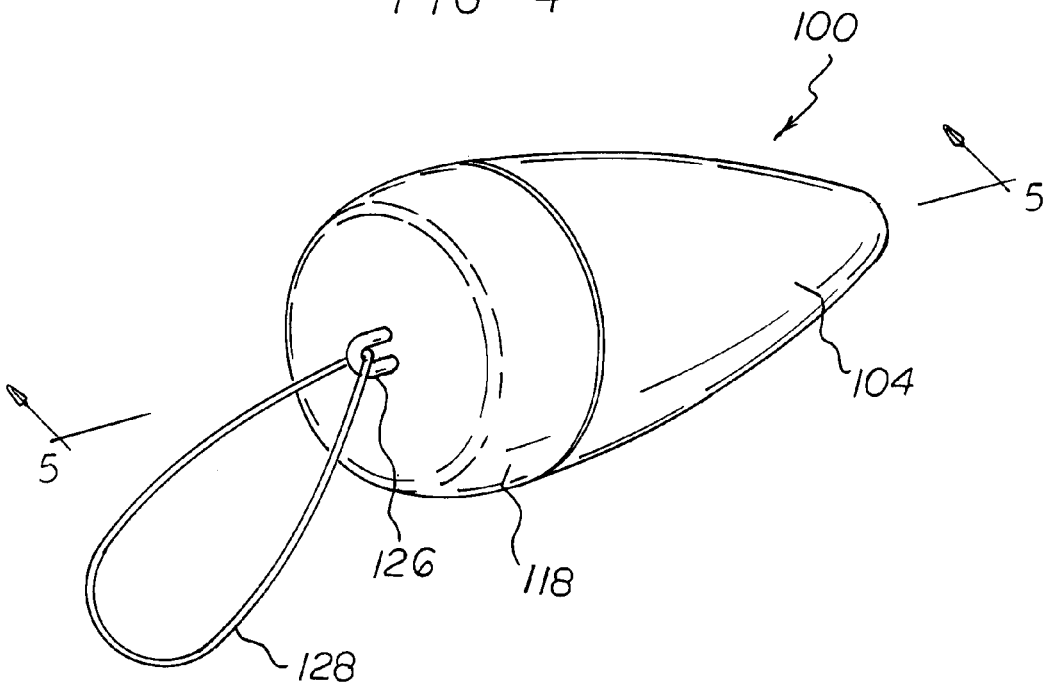
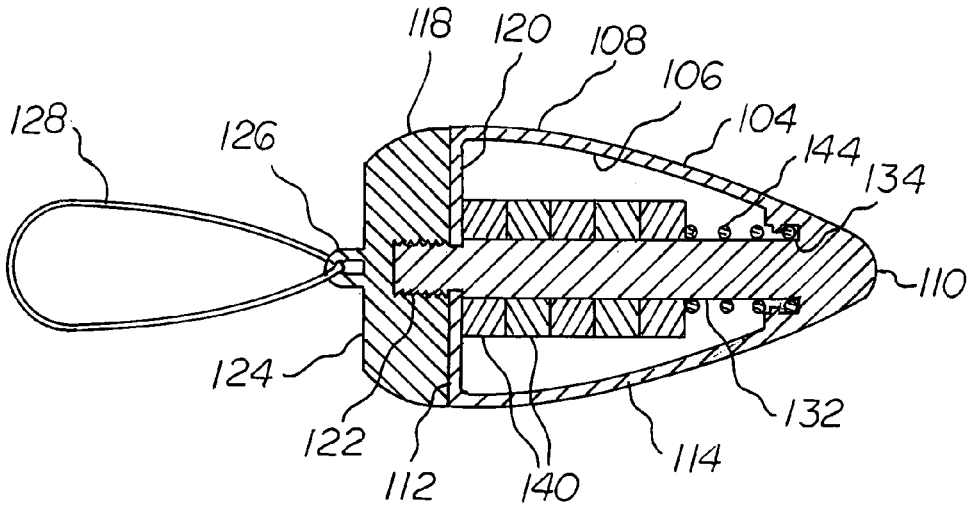
FIG 5

EXERCISE DEVICE

RELATED APPLICATION

The present application is a continuation-in-part of U.S. patent application Ser. No. 11/478,867 filed Jun. 30, 2006 now abandoned, the subject matter of which is incorporated herein by reference.

BACKGROUND OF THE INVENTION

Field of the Invention

The present invention relates to a pelvic muscle strengthening device and, more particularly, to such a device which includes a weight-adjusting means to permit the device to be adjusted to permit the use of the device with heavier weights as the pelvic muscles are strengthened through exercise with the device.

Strengthening the pelvic muscles through exercise is a common treatment for urinary incontinence in women. Various exercise devices have been provided in the past for this purpose. Such devices are intended to be inserted into the vagina of the patient. When the devices are inserted into the vagina, the pelvic muscles grip the device, thereby exercising the pelvic muscles. In this way, the repeated exercise over time strengthens the pelvic muscles, thereby reducing, and even eliminating, the problem of urinary incontinence.

As the pelvic muscle strengthens, devices of increased weight can be retained by the vagina. To obtain maximum benefit, it is desirable to provide an increasingly heavier device during the exercise program.

Also, of course, different women have a different starting point as to the weight of the device that can be retained in the vagina by exerting the pelvic muscles.

U.S. Pat. No. 4,895,363 discloses a set of devices of the same size and shape but of different weights. The proper device of the proper weight is selected for the patient, and, as the pelvic muscles of the patient strengthen, a heavier device is selected and used by the patient.

U.S. Pat. No. 5,554,092 discloses a set of devices of different sizes, each device capable of accommodating different weights.

Also of interest are U.S. Pat. Nos. 647,220 and 3,116,926 issued to Courtney and Owen respectfully.

While the prior art devices recognize the need for a device of this type which is capable of providing exercise for patients with different pelvic muscle strength and for patients as their pelvic muscles strengthen, the solutions in the prior art have been unduly complicated and require a multitude of different devices.

In this respect, the exercise device according to the present invention substantially departs from the conventional concepts and designs of the prior art, and in doing so provides an apparatus primarily developed for the purpose of strengthening pelvic muscles.

Therefore, it can be appreciated that there exists a continuing need for a new and improved exercise device which can be used for strengthening pelvic muscles. In this regard, the present invention substantially fulfills this need.

SUMMARY OF THE INVENTION

In view of the foregoing disadvantages inherent in the known types of pelvic exercise devices now present in the prior art, the present invention provides an improved exercise device. As such, the general purpose of the present invention, which will be described subsequently in greater detail, is to provide a new and improved exercise device and method which has all the advantages of the prior art and none of the disadvantages.

The present invention provides a single pelvic muscle exercise device having a relatively simple means to adjust the weight of the device. The device is provided with a shape that facilitates insertion into the vagina of a patient. The device is hollow and includes a stud extending into the interior of the device. The stud retains weights, and the number of weights provided on the stud determines the weight of the device so that the weight can be varied by adding or removing weights.

The device is used by testing at different weights to determine the heaviest weight of the device that can be retained in the vagina by the pelvic muscles of the patient. Once that weight has been determined, then the device with the number of weights on the stud to produce the desired weight is inserted into the vagina and retained for a predetermined time to provide the desired exercise of the pelvic muscle.

As the pelvic muscle is strengthened, weights can be added to the stud within the device.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise device which has all of the advantages of the prior art pelvic muscle strengthening devices and none of the disadvantages.

It is another object of the present invention to provide a new and improved exercise device which may be easily and efficiently manufactured and marketed.

It is further object of the present invention to provide a new and improved exercise device which is of durable and reliable constructions.

An even further object of the present invention is to provide a new and improved exercise device which is susceptible of a low cost of manufacture with regard to both materials and labor, and which accordingly is then susceptible of low prices of sale to the consuming public, thereby making such exercise device economically available to the buying public.

Even still another object of the present invention is to provide an exercise device for strengthening pelvic muscles.

Lastly, it is an object of the present invention to provide a new and improved pelvic exercise device comprising a conical body having a hollow interior with an interior and an exterior surface with a generally conical side wall, an end cap with a forward face formed with a threaded recess, a cylindrical stud extending into the body, the stud having a leading end and trailing end formed with threads for a removable coupling with the end cap, a plurality of weights carried by the stud, a spring within the body, and a circular central opening with slits in a cross-like configuration in the body.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective illustration of an alternate embodiment of the invention.

FIG. 5 is a cross-sectional view taken along line 5-5 of FIG. 4.

The same reference numerals refer to the same parts throughout the various Figures.

DESCRIPTION OF THE PREFERRED EMBODIMENT

Figure 1:
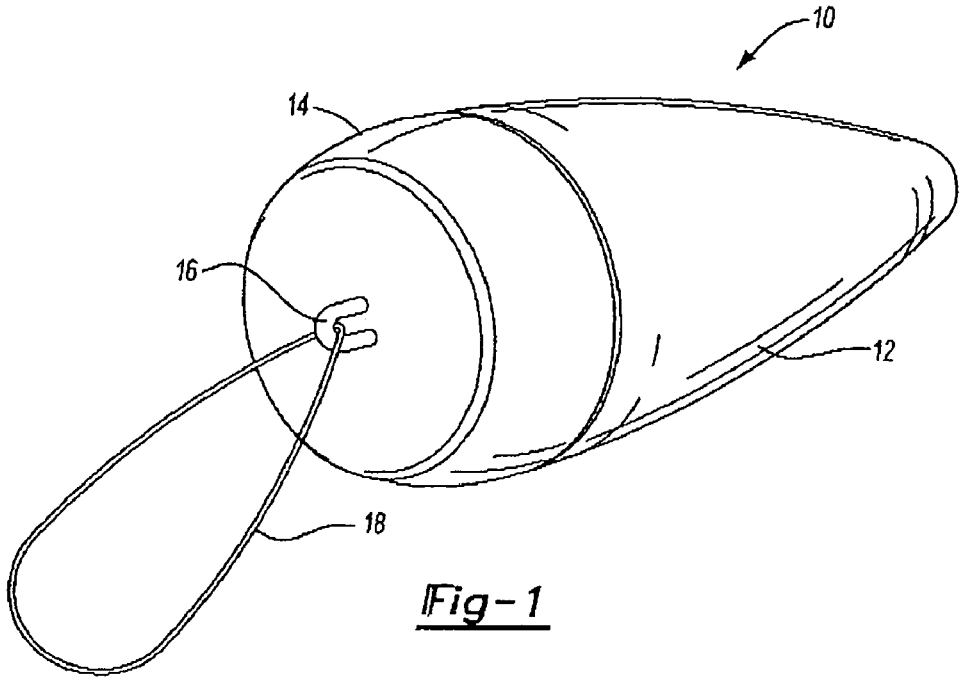
FIG. 1 is a perspective view of an exercise device of the present invention.

Referring to the drawings, FIG. 1 illustrates the exercise device 10 as having a contoured shape to be received into the vagina (not shown) of a patient. The exercise device 10 includes a body 12 and an end cap 14 secured to the body 12. An eye 16 is formed on the cap 14 to accommodate a string 18.

Figure 2:
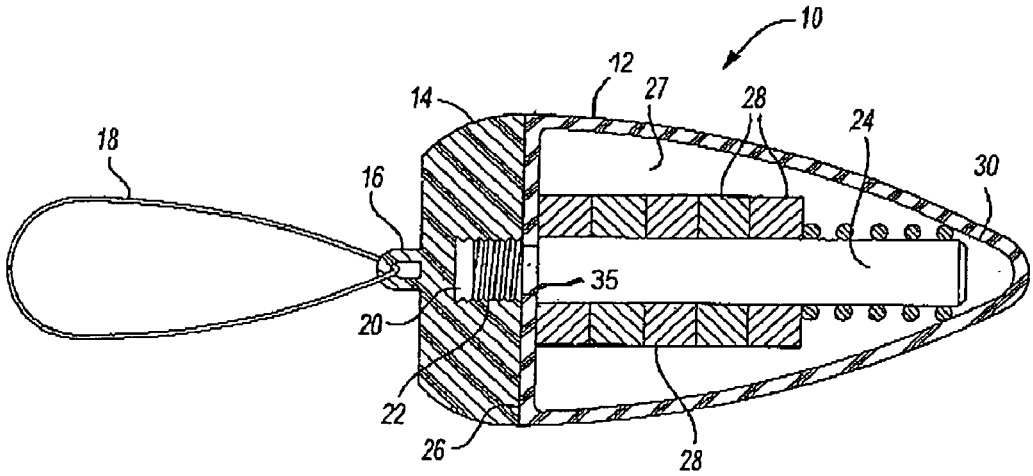
FIG. 2 is a longitudinal cross-sectional view of the exercise device shown in FIG. 1.

As can best be seen in FIG. 2, the cap 14 is solid but is provided with an internally threaded hole 20 which receives the external threads 22 of a stud 24. The body 12 is preferably formed of a soft rubber or plastic material and as can best be seen in FIG. 2 has a portion 26 which normally abuts the cap 14 and which closes an interior portion 27 of the body 12. As best seen in FIG. 2, weights 28 are provided to be carried on the stud 24 within the interior portion 27 and to be urged against the portion 26 of the body 12 by a spring 30.

Figure 3:
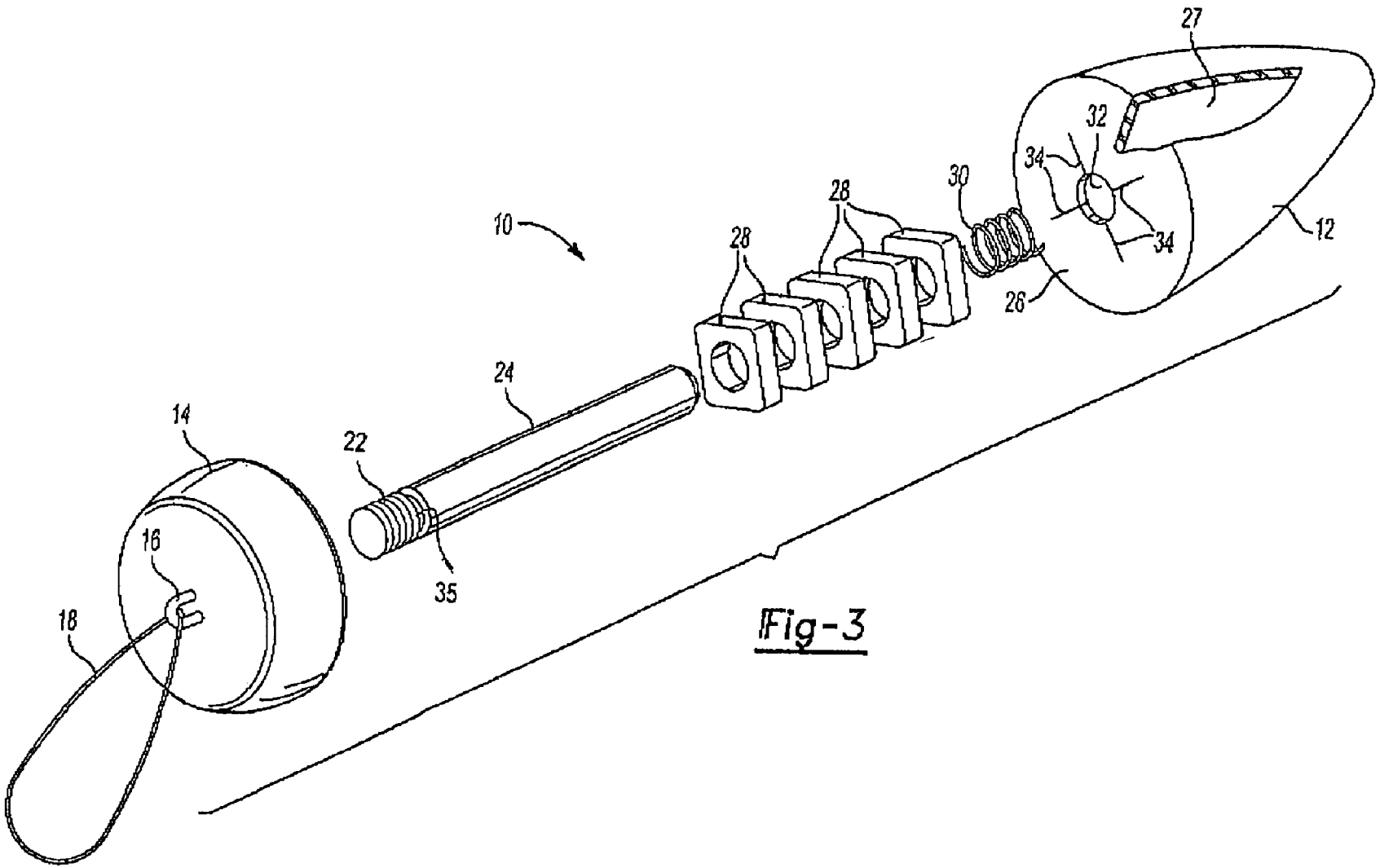
FIG. 3 is an exploded perspective view of the exercise device shown in FIG. 1 and with a portion shown in cross-section.

Referring to FIG. 3, the portion 26 of the body 12 is provided with a central opening 32 with slits 34 which permit the stud 24 with the weights 28 and the spring 30 to pass through the opening 32 and into the interior portion 27 of the body 28. The spring 30 is of a length that one end engages the interior of the body 12, and the other engages the outermost weight 28. The cap 14 is secured to the body 12 by the stud 24. Once the stud 24 with the weights 28 and the spring 30 has been inserted through the opening 32 and into the interior portion 27 of the body 12, the cap 14 is threaded on to the body 12. The stud 24 is provided with a recessed end section 35 dimensioned to capture a portion of the end wall 26 of the body 12 as can best be seen in FIG. 2 to lock the end wall 26 against the cap 14.

The weights 28 can all have the same weight, or they can be of varying weights. In any event, the weight of the device 10 that can be accommodated by a particular patient is determined by starting with a small number of weights 28 on the stud 24. The weight of the device 10 is increased by adding weights 28 to the device 10 until the patient has reached the point that she is no longer able to retain the device 10 within the vagina. The weight of the device 10 is then reduced by removing one of the weights 28. The exercise using the device 10 is then undertaken and the weight of the device 10 is gradually increased as the patient's pelvic muscles strengthen by adding weights 28 to the device 10. As indicated, the weights 28 can all be of the same weight. This is preferred because fewer different parts are required. However, the weights 28 also could have different weights without departing from the invention.

Figure 6:
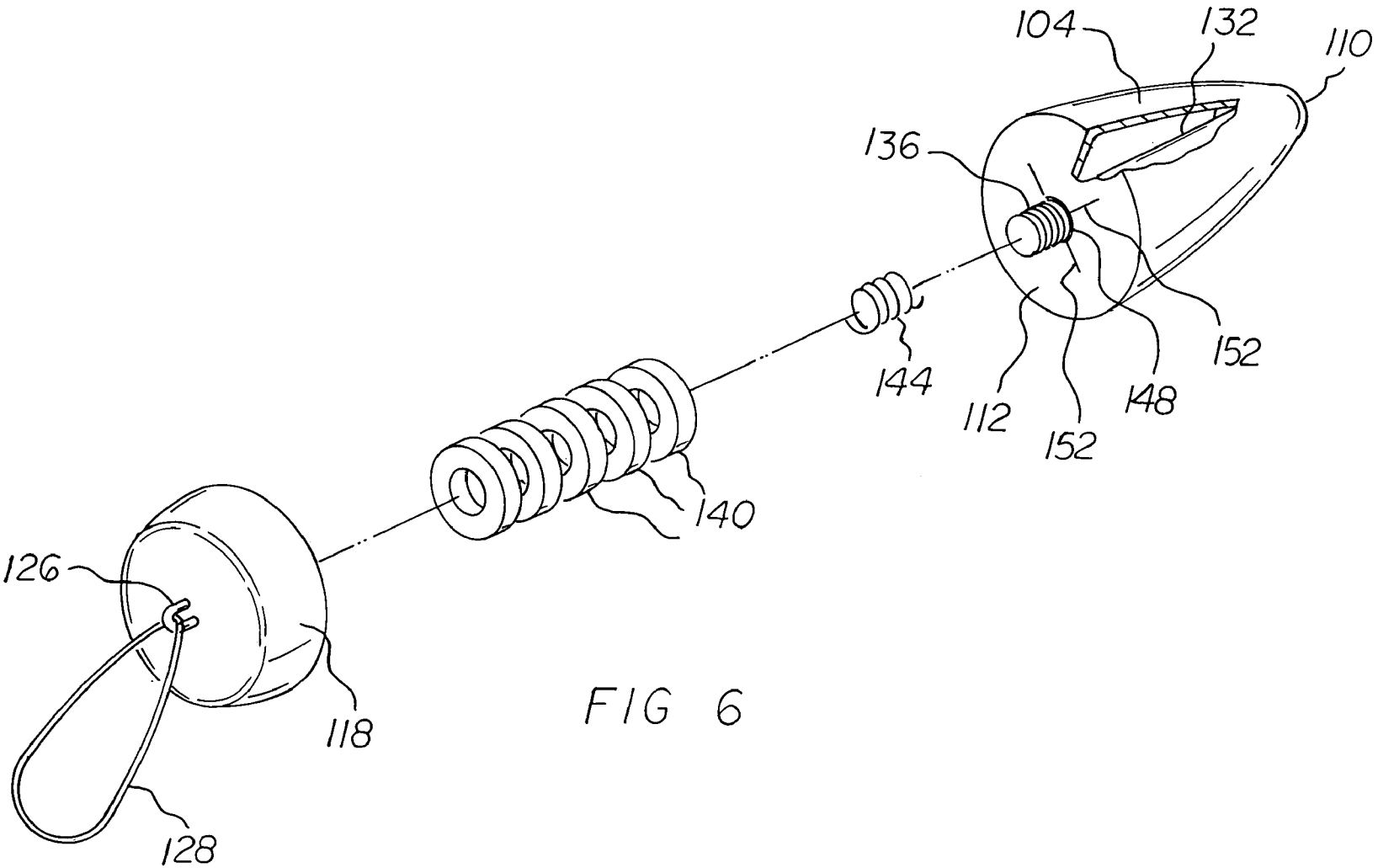
FIG. 6 is an exploded illustration of the device shown in FIGS. 4 and 5.

An alternate embodiment of the invention is illustrated in FIGS. 4, 5 and 6. The exercise device 100 of such embodiment is for insertion into the vagina of a patient to strengthen pelvic muscles. First provided is a body 104 having a hollow interior with an interior surface 106 and an exterior surface 108. The body has a smaller hemispherical leading end 110 and a larger circular trailing end 112 with a generally conical side wall 114.

Next provided in the alternate embodiment is an end cap 118. The end cap has a forward face 120 formed with a threaded recess 122 and a trailing face 124 with an eye 126 for a string 128.

A stud 132 is next provided in the alternate embodiment. The stud extends into the body. The stud has a leading end 134 integrally formed with the leading end of the body. The stud also has a trailing end formed with threads 136 for removable coupling with the end cap.

Next provided in the alternate embodiment are a plurality of cylindrical weights 140. The weights include an outermost weight carried by the stud. Each weight weighs substantially the same.

A spring 144 is next provided in the alternate embodiment. The spring is within the body around a portion of the stud. The spring has a length such that one end engages the leading end of the body and the other end engages the outermost weight.

Lastly, in the alternate embodiment, a circular central opening 148 is provided in the body. The opening has a diameter essentially equal to the stud and slits 152 in a cross-like configuration of lengths to allow the weights and the spring to pass through the opening and into the interior of the body.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise device comprising:

a generally conical body having a hollow interior with an interior and an exterior surface, the body is formed of a soft rubber or soft plastic;

an end cap with a forward face formed with a threaded recess;

a cylindrical stud extending into the hollow interior of the body, the stud having a trailing end formed with threads for removable coupling with the end cap;

a plurality of weights carried by the stud; and a circular central opening leading to the hollow interior with slits extending from the opening in a cross-like configuration in the body.

2. The device as set forth in claim 1 wherein the body has a leading edge integrally formed with a leading end of the stud.

3. The device as set forth in claim 1 and further including a spring within the body around a portion of the stud having a length such that one end of the spring engages the body and the other end of the spring engages a weight.

4. The device as set forth in claim 3 wherein the central opening is of a size to receive the stud and the slits are of a length to allow passage of the weights and spring.

5. An exercise device for insertion into the vagina of a patient to strengthen pelvic muscles, the device comprising, in combination:

a body having a hollow interior with an interior surface and an exterior surface, the body having a smaller hemispherical leading end and a larger circular trailing end with a generally conical side wall, the body is formed of a soft rubber or soft plastic;

an end cap with a forward face formed with a threaded recess and a trailing face with an eye for a string;

a stud extending into the hollow interior of the body, the stud having a leading end integrally formed with the leading end of the body and a trailing end formed with threads for removable coupling with the end cap;

a plurality of cylindrical weights including an outermost weight carried by the stud, each weight weighing substantially the same;

a spring within the body around a portion of the stud having a length such that one end engages the leading end of the body and the other end engages the outermost weight; and a circular central opening leading to the hollow interior of the body with a diameter essentially equal to the stud and with slits extending from the opening in a cross-like configuration and of lengths to allow the weights and the spring to pass through the opening and into the interior of the body.

* * * * *